US005600211A

United States Patent [19]

Luger

[11] Patent Number: 5,600,211

[45] Date of Patent: Feb. 4, 1997

[54] ELECTRONIC BALLAST FOR GAS DISCHARGE LAMPS

[75] Inventor: Siegfried Luger, Dornbirn, Austria

[73] Assignee: Tridonic Bauelemente GmbH, Dornbirn, Austria

[21] Appl. No.: 525,197

[22] Filed: Sep. 8, 1995

[30] Foreign Application Priority Data

Sep. 16, 1994 [DE] Germany ..... 44 33 085.5
Dec. 8, 1994 [DE] Germany ..... 44 43 784.6

[51] Int. Cl.[6] ..... G05F 1/00

[52] U.S. Cl. ..... 315/307; 315/291; 315/209 R; 315/DIG. 4; 315/DIG. 7

[58] Field of Search ..... 315/307, 308, 315/291, 224, 209 R, DIG. 4, DIG. 5, DIG. 7

[56] References Cited

U.S. PATENT DOCUMENTS 4,958,108 9/1990 Jorgensen ..... 315/307
5,039,921 8/1991 Kakitani ..... 315/307
5,297,015 3/1994 Miyazaki et al. ..... 315/291 X

FOREIGN PATENT DOCUMENTS

0413991A1 2/1991 European Pat. Off. .
5027565 2/1993 Japan .

*Primary Examiner*—Robert Pascal
*Assistant Examiner*—Haissa Philogene
*Attorney, Agent, or Firm*—Fitzpatrick, Cella, Harper & Scinto

[57] ABSTRACT

A control system for gas discharge lamps (5) includes a fuzzy controller (7) which, for controlling the lamp current of the gas discharge lamp, generates a setting value for an inverter (3), for setting the frequency or duty ratio of the lamp current, in dependence upon an actual value of the lamp current. Further, in accordance with the invention, fuzzy logic is employed for the purpose of recognition of the lamp type of a connected gas discharge lamp (5), in that on the basis of various detected operational parameter values, during the operation of the gas discharge lamp, the lamp type of the gas discharge lamp is determined.

25 Claims, 7 Drawing Sheets

FIG. 2

| | | Boolean Logic | | Fuzzy Logic | |
|---|---|---|---|---|---|
| A | B | $A \wedge B$ | $A \vee B$ | $A \wedge B$ | $A \vee B$ |
| 1 | 1 | 1 | 1 | 1 | 1 |
| 0 | 1 | 0 | 1 | 0 | 1 |
| 1 | 0 | 0 | 1 | 0 | 1 |
| 0 | 0 | 0 | 0 | 0 | 0 |
| 0.6 | 1 | ? | ? | 0.6 | 1 |
| 0.6 | 0.7 | ? | ? | 0.6 | 0.7 |
| 0.3 | 0 | ? | ? | 0 | 0.3 |
| 0.5 | 0.5 | ? | ? | 0.5 | 0.5 |

FIG. 3

| A \ B | Cold | Cool | Pleasant | Warm | Hot |
|---|---|---|---|---|---|
| Cold | ++ | ++ | + | o | – |
| Cool | ++ | + | + | o | o |
| Pleasant | + | o | o | – | – |
| Warm | o | o | o | – | – |
| Hot | – | – | –– | –– | –– |

++ : Strong Heating
+ : Slight Heating
o : No Change
– : Slight Cooling
–– : Strong Cooling

| Identifier for A 12° with Truth value | Identifier for B 17° with Truth value | Identifier for C with Truth value |
|---|---|---|
| Cold 0.7 | Cool 0.8 | Strong Heating 0.7 |
| Cold 0.7 | Pleasant 0.3 | Sligth Heating 0.3 |
| Cool 0.3 | Cool 0.8 | Sligth Heating 0.3 |
| Cool 0.3 | Pleasant 0.3 | Sligth Heating 0.3 |

A 12° ^ B 17° $\xrightarrow[\text{Logic}]{\text{Fuzzy}}$ C (A 12°, B 17°)

ELECTRONIC BALLAST FOR GAS DISCHARGE LAMPS

BACKGROUND OF THE INVENTION

1. Field of the Invention

The present invention relates to electronic ballasts for gas discharge lamps, and more particularly, it concerns novel ballast arrangements and novel methods of recognizing gas discharge lamps by using fuzzy controllers.

2. Description of the Related Art

In the field of electronic ballasts, there are known ballasts which work with a positively controlled oscillator and are dimmable. For dimming a gas discharge lamp to be connected to the electronic ballast, the current flowing through the lamp is varied. This is achieved with the aid of the controlled oscillator by variation of the lamp current frequency. The gas discharge lamp is controlled via a series resonant circuit in its load circuit. If the frequency of the current delivered to the gas discharge lamp corresponds approximately to the resonance frequency of the series resonant circuit, the lamp is ignited. By displacing the current frequency away from the resonance frequency of the series oscillation circuit or towards the resonance frequency of the oscillation circuit, the current of the gas discharge lamp can be reduced or increased. For controlling the lamp current, the actual value of the momentary lamp current is measured and compared with a desired value. A correspondingly present current controller generates on the basis of these two values a setting value for the current. The lamp voltage sets itself in correspondence with the lamp characteristic.

Gas discharge lamps have a negative characteristic. This means that the lamp voltage falls if the lamp current increases. If the lamp is to be controlled to be brighter, the current must thus be controlled to be higher. However, because of the negative characteristic of the lamp, the fall off of the lamp voltage works against this.

For this reason it has been proposed to control not the lamp current, but rather the lamp power, i.e. the product of lamp current and lamp voltage. The setting of the lamp power is again effected by means of the frequency. The actual value of the lamp power is measured and compared with a desired value. In order to achieve a compensation of the control difference, i.e. the difference between the actual value and the desired value, the frequency is displaced from the resonance frequency of the series resonant circuit present in the load circuit of the lamp away from or towards the resonance frequency in dependence upon the sign of the control difference. Such ballasts have, however, the disadvantage that solely the lamp power can be monitored. Since only the product of lamp voltage and lamp current is controlled, it is not excluded that the electronic ballast might in some circumstances be controlled into an unstable or non-permitted region. It is thus, for example, conceivable that a limit value for the maximum permissable lamp power is complied with but a limit value for a maximum permissable lamp current is exceeded.

SUMMARY OF THE INVENTION

An object of the invention is to provide an improved electronic ballast for gas discharge lamps, which in particular avoids the above-mentioned disadvantages.

The object is achieved in accordance with the invention by means of a rectifier arranged to rectify a supply voltage, an inverter which is fed from the rectifier, a load circuit which is connected to the inverter and which can be connected to at least one gas discharge lamp and a control device with a comparator for controlling the brightness of the gas discharge lamp. The control device includes a fuzzy controller which, in dependence upon at least one input signal, determines as an output signal, a setting value for a physical parameter of at least one of the inverter and the load circuit.

In accordance with the invention, use is made of fuzzy logic control techniques, i.e. the brightness of the connected gas discharge lamp is controlled by a fuzzy controller which generates a setting value for a physical parameter of the inverter or of the load circuit of the electronic ballast in dependence upon at least one input parameter. Thereby, the lamp current is preferably controlled, i.e. the actual value of the lamp current is detected, supplied to a comparator, which compares the actual value with a desired value provided and supplies the control difference derived therefrom to the fuzzy controller. In accordance with the rules of fuzzy logic, the fuzzy controller generates a setting value signal for the inverter or the load circuit in dependence upon the control difference. Preferably, the frequency or the duty ratio of the lamp current or the lamp voltage is set by means of the setting value signal of the fuzzy controller. Through the prescription of decision rules, into which corresponding values based on experience can be incorporated, the fuzzy controller ensures that the lamp is not controlled into unstable region.

Alternatively to current control, voltage control or power control is also conceivable.

For a comprehensive control of the lamp brightness, the environmental temperature and/or the winding resistance of the gas discharge lamp can also be detected and supplied to the fuzzy controller. With the aid of this information, in conjunction with the detected lamp voltage, the fuzzy controller can make a determination of the degree of aging of the connected gas discharge lamp.

The desired value signal of the comparator of the control device can be externally variable, e.g. by means of a dimmer, or be stored as a predetermined fixed value.

Further, it is recommended in accordance with the invention to apply the fuzzy controller as an exponentially or logarithmically functioning member, so that there exists an exponential or logarithmic relationship between the output parameter of the fuzzy controller and its input parameter. This is—as will be explained below—particularly advantageous for providing a linear relationship between the brightness power taken up by the gas discharge lamp and the brightness subjectively perceived by the observer.

A particular feature of fuzzy logic lies in that not all input parameters need be evaluated in order to obtain the output parameter. For example, if one or more input parameters attain a predetermined limit value, the fuzzy controller sets the output parameter to a particular value independently of the remaining input parameters. The output value of the fuzzy controller depends solely upon the constitution of the decision rules, i.e. the so-called fuzzy rules.

Advantageously, the fuzzy logic is further employed also for the recognition of the lamp type of the connected gas discharge lamps. From EP-A-0 413 991 it is known to detect the ignition voltage of the connected gas discharge lamp and to infer the lamp type on the basis of the detected ignition voltage. The determination of the ignition voltage depends, however, inter alia upon the manufacturer, the degree of aging, the gas filling and the heating of the lamp, so that there may be overall variations upon the detection of the ignition voltage in the region between 10% and 20%.

According to a further feature of the invention, there is provided a new process with the aid of which, by means of the detection of at least one operational parameter after bringing into operation of the gas discharge lamp, the lamp type can be determined. The solution in accordance with the invention has the advantage that a plurality of different operational parameters can be employed for evaluation of the lamp type, which have differing susceptibilities to variation. For this reason, fuzzy logic is advantageously employed for determining the lamp type, which because of the free constitution of the fuzzy rules, allows the individual parameters to be evaluated individually or in combination. A corresponding solution involves the fuzzification of at least one of the operational parameters in accordance with fuzzy logic, prescription of at least one decision rule which allocates the at least one fuzzified operational parameter of the gas discharge lamp to one of a plurality of predetermined lamp types, in accordance with the fuzzy logic, and selection of one lamp type from the plurality of predetermined lamp types in dependence upon the various lamp current desired values and the respectively detected fuzzified actual values of the at least one operational parameter on the basis of the at least one decision rule.

If the lamp type of the connected gas discharge lamp is determined this is preferably stored in a memory in the form of various operational parameters or in the form of the corresponding lamp characteristic, so that the lamp type need not be continually checked and detected, so long as the gas discharge lamp concerned is not exchanged. The exchange of the lamp can be detected by means of detection of a possible interruption of the heating current circuit.

After determination of the lamp type the corresponding controller of the electronic ballast controls the brightness of the connected gas discharge lamp in dependence upon its type. Ideally, the determined lamp type is indicated optically and/or acoustically, so that the user has continuous knowledge of the lamp type employed.

Further advantageous embodiments of the invention are described more specifically hereinafter.

BRIEF DESCRIPTION OF THE DRAWINGS

In the accompanying drawings:

FIG. 2 is a table showing a comparison of Boolean logic and fuzzy logic processing of the Membership Functions of the different parameters of FIG. 1*a*, FIG. 1*b* and FIG. 1*c;*

FIG. 3 is a table which shows, for different combinations of input parameters of FIG. 1*a* and FIG. 1*b*, corresponding output parameters;

DETAILED DESCRIPTION OF THE PREFERRED EMBODIMENT

The invention will now be described in more detail on the basis of preferred exemplary embodiments with reference to the drawings.

As mentioned above, in accordance with the invention fuzzy logic is employed in an electronic ballast for gas discharge lamps. The generally valid statements of fuzzy logic are briefly set out in the following.

Fuzzy logic is a logic which works with imprecise statements. The individual parameters of fuzzy logic are quantified, i.e. for each parameter only particular ranges of value are permitted. The quantification of the individual parameters is effected in accordance with so-called membership functions, whereby there is allocated to the actual value of an input parameter of the fuzzy logic a corresponding value range according to its membership function and a corresponding truth value (degree of fulfilment). The quantified input parameters are, with their truth values, combined according to particular decision rules, so that an output parameter—likewise quantified—of the fuzzy logic system can be derived. The quantified output parameter is then transformed into concrete output parameter in accordance with particular method.

The main procedures of fuzzy logic will now be explained with reference to the example of a temperature control, as is described for example in the report "Technology Profile Fuzzy logic", Marcello Hoffman, SRI International, June 1994.

Figure 1A:
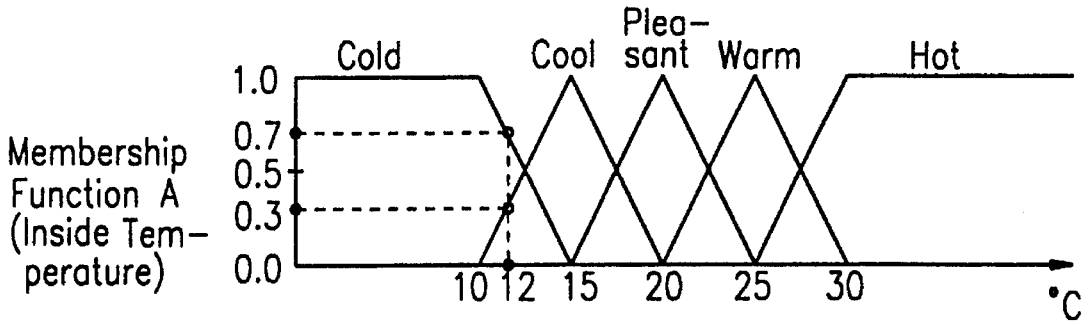
FIG. 1*a*, FIG. 1*b* and FIG. 1*c* are diagrams showing the relationship between "Membership Function" and value regions at different temperatures, for different parameters, in an explanatory example of fuzzy logic used in the present invention.
Figure 1B:
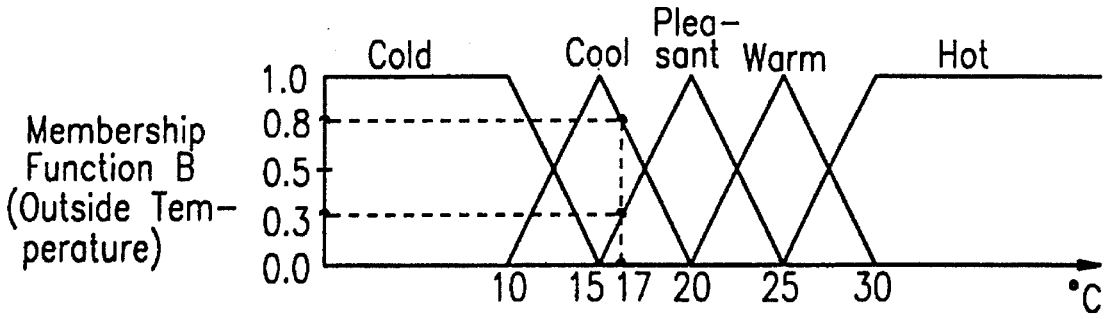
Figure 1C:
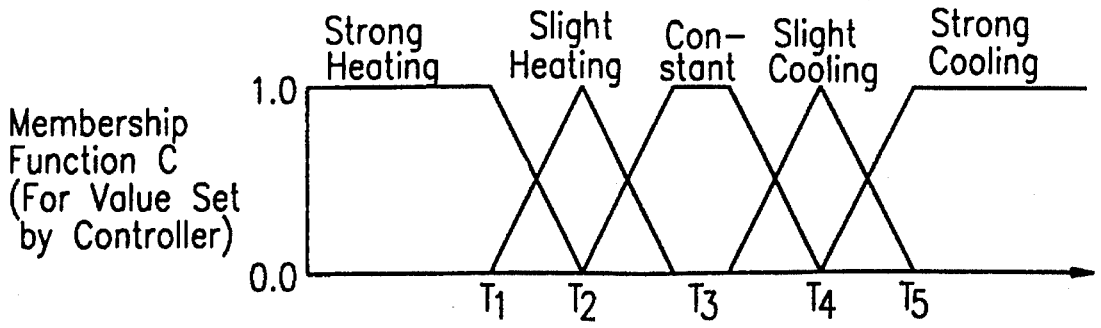

It is assumed that the heating of a room should be controlled in dependence upon the inside and outside temperature of the room. As shown in FIG. 1*a* and FIG. 1*b*, the two input parameters, i.e. the inside and as shown in FIG. 1*c* outside temperatures, and the output parameter, i.e. for example the setting value for the temperature of a heating boiler, are quantified in accordance with corresponding membership functions. Only five values regions are allocated to each parameter, which value regions are separated one from another in accordance with their corresponding membership functions. The form of the membership functions as represented in FIG. 1*a*, FIG. 1*b* and FIG. 1*c* is by no means compulsory. The individual regions may also be configured to be selectively non-overlapping and non-triangular. A concrete input value of the fuzzy controller is then associated with one or more regions by reference to its corresponding membership function, in dependence upon whether or not the regions for the concrete input value cross over. Further, for the concrete input value and each of its allocated regions a corresponding truth value or degree of fulfilment is determined.

For the purpose of explaining this procedure, it is assumed that for the two input parameters five value regions "cold", "cool", "pleasant", "warm", and "hot" are available. The value region "cool" runs for example between 10° C. and 20° C. If the input parameter A were 15° C. there would be allocated thereto the value region "cool" with a truth value of 1.0. For a correspondingly lower or higher value in this value region, the associated truth value would be reduced in accordance with the membership function.

Analogously thereto, the output parameter of the controller is also quantified, i.e. divided into particular value regions. As shown in FIG. 1, there are available for the output parameter the identifiers (labels) "strong heating", "slight heating", "constant", "slight cooling" and "strong cooling", which are each defined between particular temperature limits. The individual temperature limits are determined in accordance with particular values based on experience. If, for the output parameter, there is yielded the identifier "slight cooling" with a truth value of 1.0, this would signify the setting value $T_4$ for the heating. If a correspondingly lower value is yielded for the output parameter, the setting value for the heating varies in accordance with the membership function C.

The procedure of quantification of the input parameters and output parameters will be called "fuzzification" and "defuzzification". In the following, by way of example, it will be assumed that the inside temperature is 12° C., as shown in FIG. 1*a*, and the outside temperature is 17° C. as shown in FIG. 1*b*. In correspondence to the membership functions represented in FIG. 1*a* there is thus yielded for the input parameter A a truth value 0.7 for the identifier "cold" and a truth value to 0.3 for the identifier "cool". In correspondence to the membership functions represented in FIG. 1*b* there is yielded for the input parameter B there is yielded, a truth value 0.8 for the identifier "cool" and a truth value 0.3 for the identifier "pleasant". By means of the membership functions, there is thus generated for each concrete input value of inside temperature and outside temperature in each case a pair of values consisting of an identifier and a truth value associated therewith. Since, in the example shown in FIG. 1*a*, FIG. 1*b* and FIG. 1*c*, the individual value regions for the selected temperature values cross over one another, there are yielded in total four value pairs which are to be combined with one another to determine a concrete setting value for the heating boiler temperature. The individual value pairs are each combined with one another in a cross-over fashion, whereby the laws of fuzzy logic are to be observed. FIG. 2 shows the laws of fuzzy logic in comparison to Boolean logic. For the combination of discrete values A and B having a truth content of 1 or 0, fuzzy logic corresponds to Boolean logic. If, however, one of the input parameters A and B has a value between 0 and 1, Boolean logic can no longer be applied. Fuzzy logic provides for an AND combination of the input parameters the minimum value of the two input parameters and for an OR combination the maximum value of the two input parameters, so that in principle fuzzy logic corresponds to Boolean logic but with the exception that fuzzy logic can also combine with one another non-definitive values between 0 and 1.

Figures 4A, 4B:
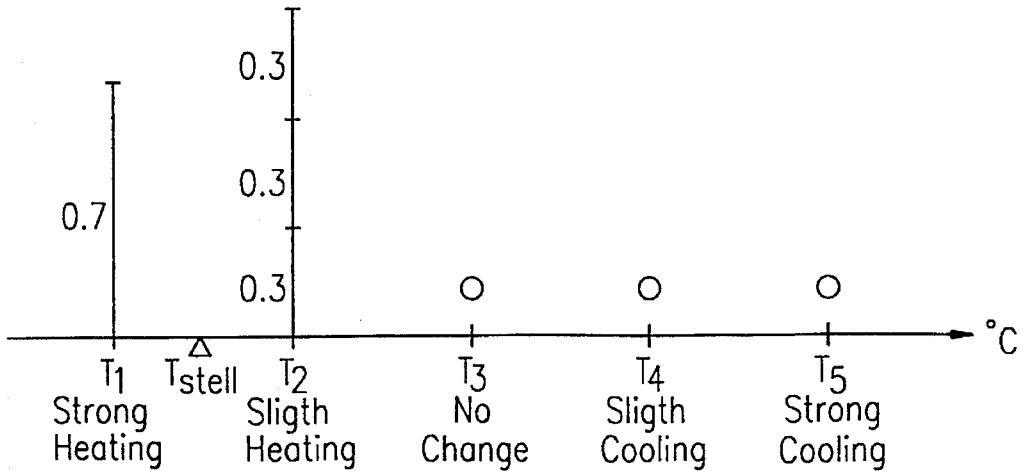
FIG. 4*a* is a table showing the relationship between specific values input and output parameters of FIG. 1*a*, FIG. 1*b* and FIG. 1*c;*
FIG. 4*b* is a chart showing a center of gravity calculation technique in defuzzification of the output parameters shown in FIG. 4*a;*

The individual value pairs of the input parameters A and B, which are obtained in correspondence with the membership functions in FIG. 1*a*, FIG. 1*b* and FIG. 1*c*, are then combined with one another in accordance with particular rules, the so-called fuzzy rules. For each individual combination of a value pair of the input parameter A with a value pair of the input parameter B there is yielded the particular quantified output parameter C. The individual fuzzy rules are established in accordance with particular values based on experience. FIG. 3 shows a corresponding combination diagram with the associated legends. The allocation of a particular identifier of the output parameter C to a particular combination of the input parameters A and B is effected initially without consideration of the corresponding truth values. For example from FIG. 3 it can be seen that for the input parameter A having the identifier "cold" and the input parameter B having the identifier "cool" there is yielded the identifier "strong heating" for the output parameter C. In each case the two values pairs of the input parameters A and B are combined with one another corresponding to the diagram shown in FIG. 3, which represents the fuzzy rules for this example, so that in all four combination variations of the input parameter A and the input parameter B, with their corresponding truth values, are yielded. The individual combination possibilities are represented in FIG. 4*a*. For the combination of the individual identifiers of the input parameters A and B there is determined an identifier for the output parameter C in accordance with the diagram represented in FIG. 3. Then, a truth value is likewise allocated to the identifier in accordance with the rules of calculation of the fuzzy logic shown in FIG. 2, from the truth values of the individual value pairs for the input parameters A and B. As described above, the truth value of the quantified output parameter C corresponds to the minimum of the two truth values of the input parameters A and B combined with one another. In this way, there is determined for each combination of the value pairs of the input parameters A and B each consisting of an identifier and a truth value, a value pair for the quantified output parameter C, consisting of an identifier and a truth value. There are thus obtained, as shown in FIG. 4*a*, in this example, four value pairs for the output parameter C.

The last remaining step for the determination of a concrete setting parameter for the heating is the transformation of the four value pairs of the quantified output parameter C into a concrete controller setting value. For this purpose the four different value pairs of the output parameter C are combined with one another to obtain a particular concrete setting value. The procedure is called defuzzification.

For the procedure of defuzzification various methods have been proposed. However, the most practical method is the so-called surface centre of gravity method which works with weighted components and thus forms quasi a weighted mean from the individual value pairs of the quantified output parameter C.

FIG. 4*b* is intended to indicate the manner in which this method functions. Above the individual identifiers of the output parameters C there are entered in each case the associated truth values. In accordance with FIG. 4*a* there was yielded for the quantified output parameter C in one case the identifier "strong heating" with a truth value 0.7 and in three cases the identifier "slight heating" each with a truth value 0.3. The remaining identifiers of the associated membership function C were not detected, which in each case corresponds to a truth value 0 for these identifiers. For the thus obtained figure the centre gravity is calculated in accordance with the following formula:

$$T_{Stell} = \frac{T_1\,0.7 + (0.3 + 0.3 + 0.3)\,T_2}{0.7 + 0.3 + 0.3 + 0.3}$$

In this example, the calculated center of gravity corresponds to the concrete setting value for the heating boiler temperature. If it is assumed for example that $T_1$ corresponds to a heating boiler temperature for the heating of 80°

C. and $T_2$ corresponds to a heating boiler temperature of 70° C., then a setting value of 74° C. is yielded for the heating boiler temperature.

In this way, with the aid of fuzzy logic, there can be determined quickly and simply, with the aid of non-definitive characterisations and corresponding truth values, concrete setting values for a controller. In particular in the field of programming, fuzzy logic has many advantages, since automatic applications can be quickly realised in a economical manner.

In accordance with the invention, the above-described fuzzy logic is applied to an electronic ballast for gas discharge lamps.

Through the application of fuzzy logic a series of advantages are provided for the electronic ballast in accordance with the invention as compared with the known electronic ballast. The principle advantages of fuzzy logic are for example described in "Fuzzy-Logik, die unscharfe Logik erobert die Technik", Daniel McNeill and Paul Freiberger, Droemer Knaur Verlag, 1994. Thus, for example, as compared with digital control, logic control has the advantage that a control difference which might exist is reduced stepwise while with comparable digital controllers the sought after desired value is often over- or under-shot, so that this over-control must again be quickly compensated. This advantage of fuzzy logic can be exploited in particular on the ignition of gas discharge lamps. Gas discharge lamps are switched on or ignited by bringing the frequency of the lamp current nearer to the resonance frequency of the series resonant circuit present in the load circuit. If, after switching on, the lamp is to be operated at a low brightness, it is thus necessary after switching on to rapidly control downwards the brightness of the lamp, whereby with conventional systems under-shoots below the desired brightness occur, which in the worst case can lead to the lamp being extinguished.

Figure 5:
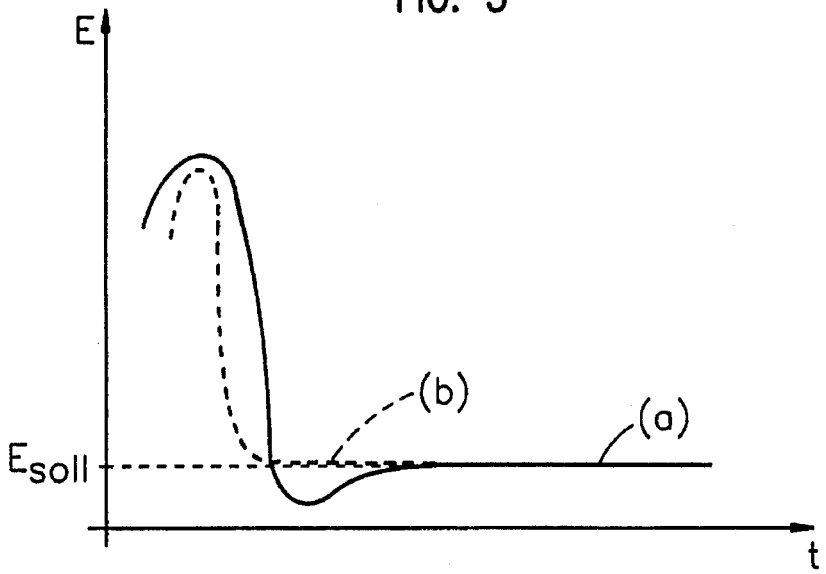
FIG. 5 is a diagram for comparative representation, one against the other, of the brightness characteristic of a conventional controller with that of a fuzzy controller.

In FIG. 5, (*a*) represents the time-dependent characteristic of the lamp brightness E during an ignition process of the gas discharge lamp. It is apparent that during the controlling downwards of the lamp brightness there occurs an under-shooting of the sought for desired brightness $E_{soll}$, so that to achieve the desired value a compensation control is necessary. With fuzzy logic, however, an improved approach to the desired brightness is possible, without under- or over-shoots. For comparison, there is represented in FIG. 5 the brightness characteristic (*b*) which can be achieved with a fuzzy controller.

Moreover, with the assistance of fuzzy logic, a particularly rapid response or setting of the output parameter is possible, so that with the employment of a fuzzy controller a control difference present can be more quickly compensated, as can be seen from FIG. 5. Further advantages of fuzzy logic can be perceived in that in comparison with known control systems lesser information is needed and additionally that verbal formulations can be directly derived from this information, since fuzzy logic works with linguistic terms. For this reason, human knowledge can be in co-opted into the system by the simplest manner and means, without there being necessary a transformation into complex mathematical models.

Figure 6:
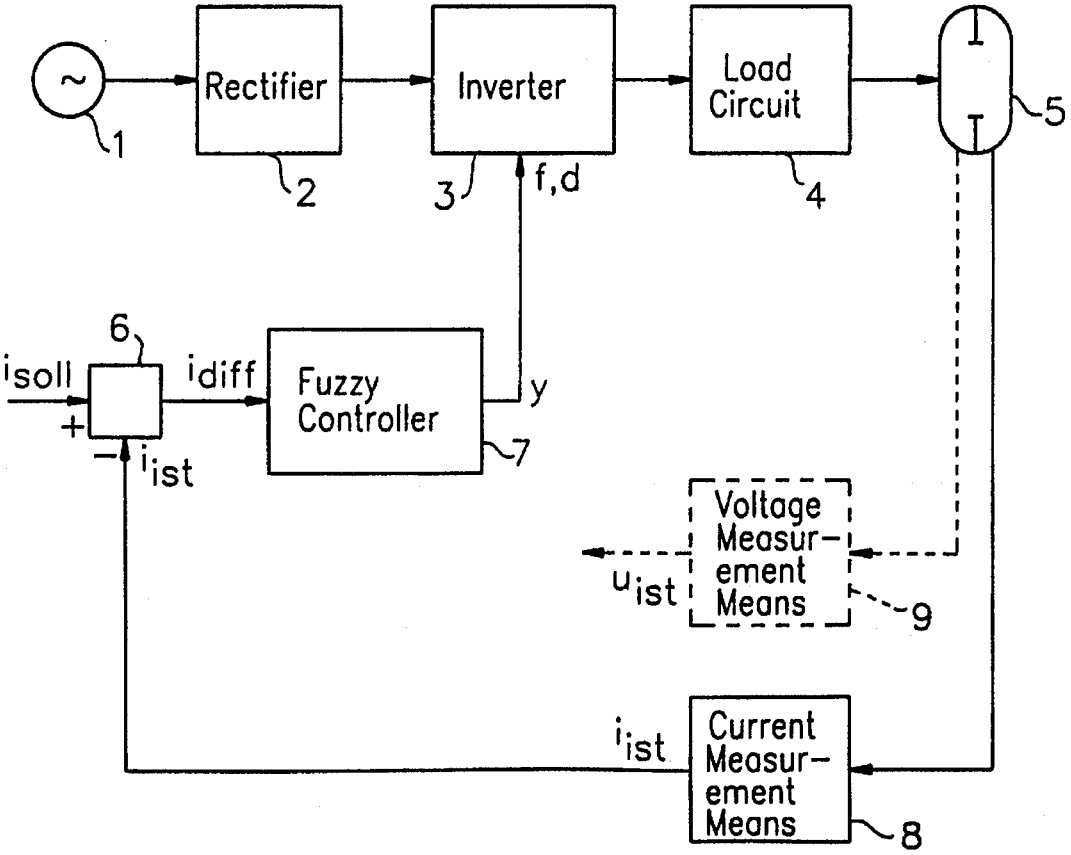
FIG. 6 is a schematic block circuit diagram of a first exemplary embodiment of the invention.

In accordance with the invention, the above-described fuzzy logic is applied in an electronic ballast for gas discharge lamps. FIG. 6 shows a first exemplary embodiment of the ballast in accordance with the invention.

The electronic ballast includes a rectifier 2, fed from a supply voltage source 1, which is connected with an inverter 3. A load circuit 4 is connected to the inverter 3, which load circuit serves for control of a gas discharge lamp 5 and usually includes, inter alia, a series resonant circuit for igniting the connected gas discharge lamp 5. The electronic ballast further includes a control device, which includes a controller 7 and a comparator 6. In accordance with the invention, the controller 7 is formed as a frequency controller. The control device may be arranged in the electronic ballast or alternatively externally. Preferably, the lamp current of the connected gas discharge lamp is controlled. For this purpose, the lamp current is detected by a current measurement means 8 and the instant actual value of the lamp current $i_{ist}$ is delivered to the comparator 6. The comparator 6 compares the actual value $i_{ist}$ of the lamp current with a set lamp current desired value $i_{soll}$, whereby the current desired value $i_{soll}$ corresponds to a set dimming desired value which is provided for example from a dimmer to the comparator 6. The current desired value $i_{soll}$ or the set dimming desired value can be manually temporally altered, as is for example the case with usual dimming devices, or be present in form of a non-alterable fixed, for example stored, value. On the basis of the comparison of the current desired value $i_{soll}$ with the actual value $i_{ist}$, the comparator 6 determines a control difference value $i_{diff}$ which is applied to the fuzzy controller 7. In dependence upon the input parameter $i_{diff}$, the fuzzy controller generates a setting value y for the inverter 3. Usually, the lamp brightness is set by means of setting the frequency f or the duty ratio d of the lamp current of the connected gas discharge lamp 5. With the aid of the fuzzy controller, however, setting values for other physical parameters of the inverter 3 or of the load circuit 4 can also be generated. Likewise, the invention is not limited to the exemplary embodiment shown in FIG. 6. Rather, the fuzzy controller might also be employed for controlling the lamp voltage or the lamp power. For this purpose, as shown by broken lines in FIG. 6, there is provided a voltage measurement means 9, which detects the instant lamp voltage and generates an actual value of the lamp voltage $u_{ist}$. In order to be able to control the lamp voltage, the lamp voltage actual value signal $u_{ist}$ detected by the voltage measurement means 9 is applied to the comparator 6 in place of the lamp current actual value signal $i_{ist}$ and is compared there with a voltage desired value, the comparator 6 then delivering a corresponding control difference signal for the voltage to the fuzzy controller. If the lamp power is to be controlled, the actual values $i_{ist}$ and $u_{ist}$ delivered from the current measurement means 8 and the voltage measurement means 9 are to be multiplied with one another, for example the aid of a multiplier and the thus obtained power actual value applied to the comparator 6 which therefrom, by means of comparison with a set power desired value, applies a corresponding control difference signal to the fuzzy controller. At this point it should, however, be noted that current control, as shown in FIG. 6, represents the common form of control. The reason for this can be seen in that because of the negative characteristic of the lamp many lamp current values can be allocated to one lamp voltage value, so that with voltage control ambiguities would appear. In contrast thereto there exists for each lamp current value solely one individual lamp voltage value, so that with the aid of current control ambiguities can be avoided.

Likewise it is also possible in accordance with the invention to apply the lamp voltage $u_{ist}$, detected by the voltage measurement means 9, directly to the fuzzy controller 7 as a further input parameter of the fuzzy controller 7. In this case, the fuzzy controller 7 then combines the two input values $i_{diff}$ and $u_{ist}$, which are present in fuzzified form, and determines on the basis of previously set out decision rules a corresponding setting value signal y for the inverter 3 or the load circuit 4 of the electronic ballast. Because of the above-described characteristics of fuzzy logic it is in principle possible, in contrast to conventional controllers, to evaluate particular input parameters and to combine them with one another, with neither the input parameters nor the output parameter having to relate to the same physical quantity (e.g. current or voltage). As further input parameters there may be supplied to the fuzzy controller 7 also actual values of the outside temperature and/or of the winding resistance of the gas discharge lamp. This will be described in more detail with reference to the following exemplary embodiment. Because of the characteristics of fuzzy logic, with the aid of the circuitry in accordance with the invention, the brightness of the connected gas discharge lamp can be very effectively, quickly and simply set. For this purpose, all input parameters of the fuzzy controller 7 and the output parameter(s) of the fuzzy controller are fuzzified. From a concrete value pair of the input parameters applied to the fuzzy controller there are obtained one or more fuzzified values for the output parameter of the fuzzy controller 7 and there is derived therefrom a concrete value for the output parameter by means of defuzzification, as described above. As shown in FIG. 6, the concrete defuzzified setting value y of the fuzzy controller 7 is applied to the inverter 3 or the load circuit 4 in order to set preferably the frequency or the duty ratio of the lamp current or the lamp voltage.

Figure 7:
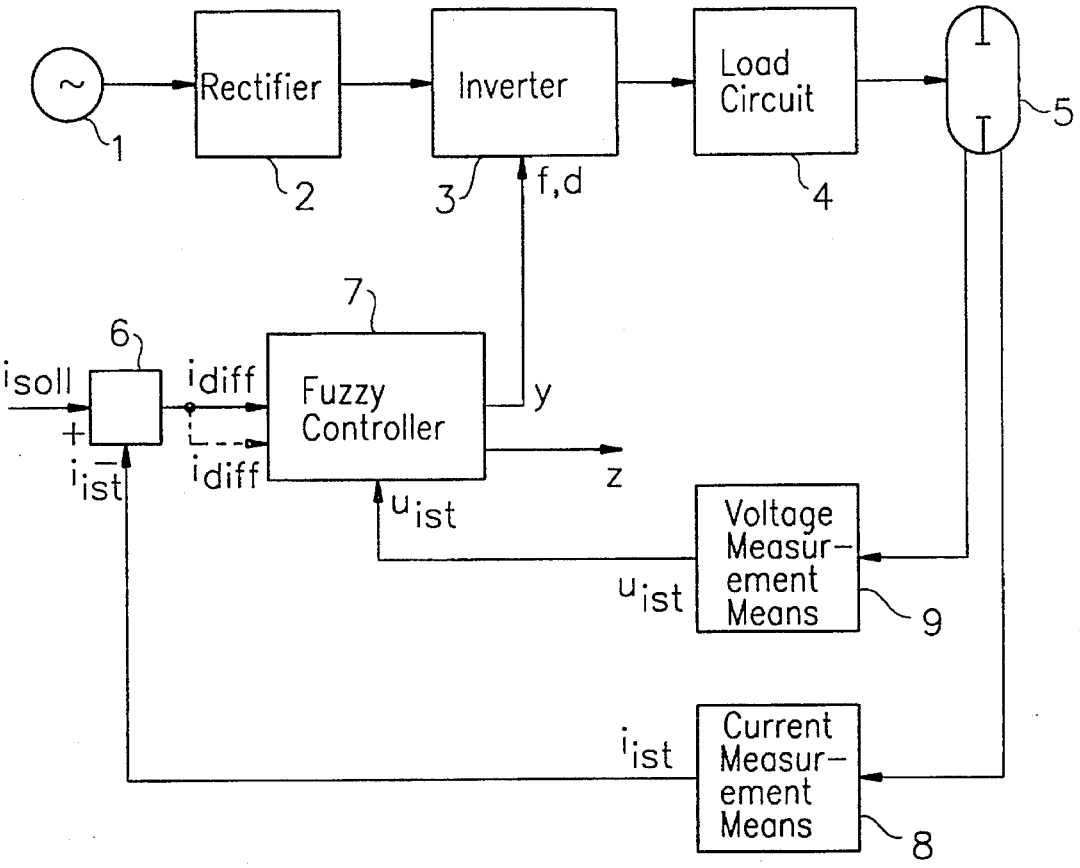
FIG. 7 is a schematic block circuit diagram of a second exemplary embodiment of the invention.

FIG. 7 shows a further exemplary embodiment which differs from the first exemplary embodiment shown in FIG. 6 in that, as described above, the lamp voltage is also monitored by a voltage measurement means 9 and a corresponding lamp voltage actual value $u_{ist}$ is applied to the fuzzy controller 7 as a further input parameter. Moreover, along with the setting value y for the inverter 3, the fuzzy controller 7 in FIG. 7 generates a further output signal z. In the drawing corresponding parts of the block circuit diagram are indicated by the same reference signs. With the second exemplary embodiment shown in FIG. 7, the fuzzy controller 7 can, with the aid of the supplied voltage $u_{ist}$, infer the aging of the gas discharge lamp 5. For this purpose, the fuzzy controller associates with each fuzzified lamp voltage value $u_{ist}$ a corresponding degree of aging, on the basis of previously laid down decision rules, in accordance with fuzzy logic, whereby the degrees of aging are also present in fuzzified form. After defuzzification of the degree of aging has been achieved, i.e. after transformation of the fuzzified degree of aging into a concrete aging value, the fuzzy controller 7 delivers the corresponding output signal z. Further, the fed-back voltage $u_{ist}$ can also be employed for constant control of the lamp power. The lamp voltage of the gas discharge lamp varies in dependence upon the environmental temperature, so that for the constant control of the lamp power it is necessary to increase or to reduce the current value in dependence upon the instant lamp voltage $u_{ist}$. In this connection it should be noted that the brightness of the connected gas discharge lamp is approximately proportional to the lamp power. It is likewise indicated in FIG. 7 that along with the control difference value $i_{diff}$, alternatively or selectively in addition thereto, the temporal gradient $i'_{diff}$, i.e. the temporal variation of the control difference $i_{diff}$ can be supplied to the fuzzy controller 7, since for example also for the recognition of the degree of aging of the connected gas discharge lamp the temporal rate of change of the lamp current is of interest and can correspondingly be employed for determining the degree of aging.

Figure 8D:
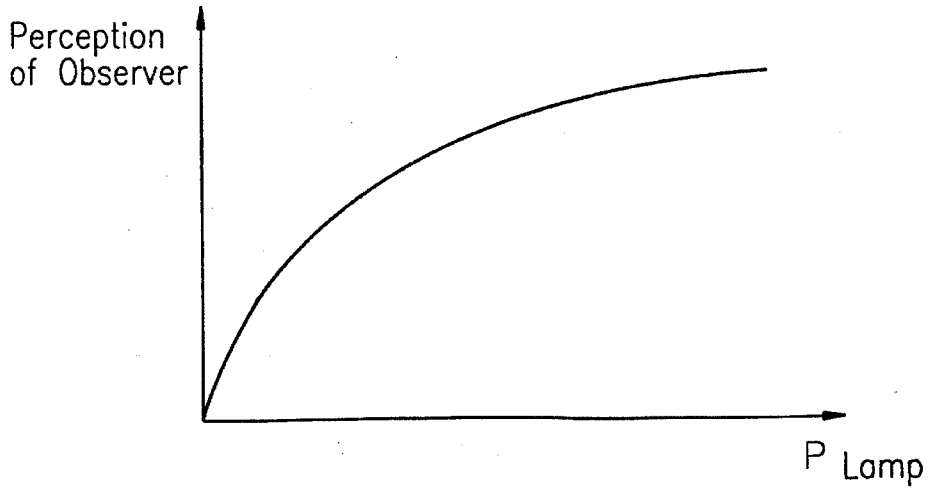
FIG. 8*a*, FIG. 8*b*, FIG. 8*c* and FIG. 8*d* are representations which indicate the application of the fuzzy controller in accordance with the invention as an exponential function member.

At this point, attention is directed to a further possible application of the fuzzy controller 7 in relation to electronic ballasts for gas discharge lamps. It is generally known that there exists a logarithmic relationship between the brightness power taken up by a lamp and the subjective perception of an observer, as is for example shown in FIG. 8*d*. This means, on the one hand, that upon a doubling of the brightness power taken up by a lamp the observer will not also perceive a doubling of the brightness. It follows therefrom, on the other hand, that for a linear increase of perception with respect to the brightness power taken up by the lamp, an exponential increase in the brightness power taken up by the lamp is necessary, so that a linear relationship between the brightness power of the lamp and the actual perception of the observer can be ensured.

Figure 8A:
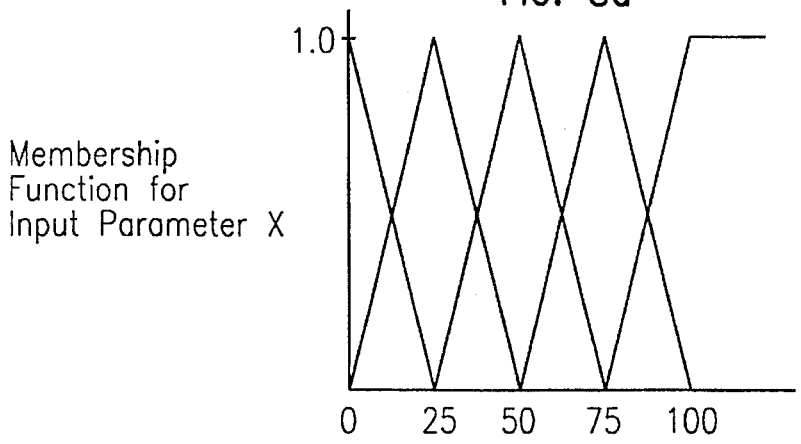
Figure 8B:
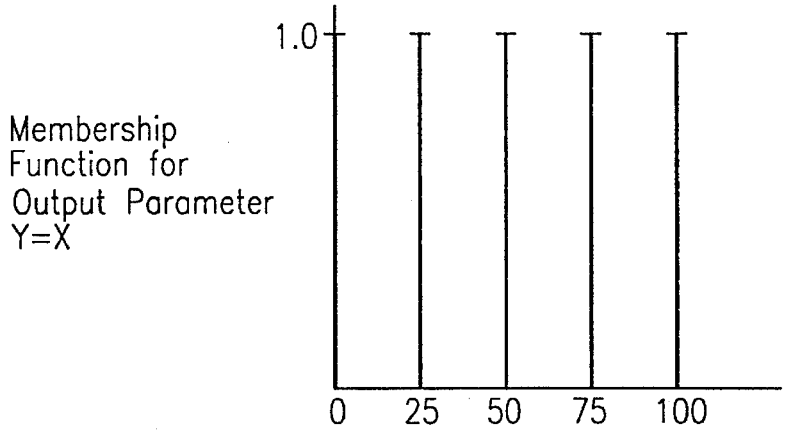
Figure 8C:
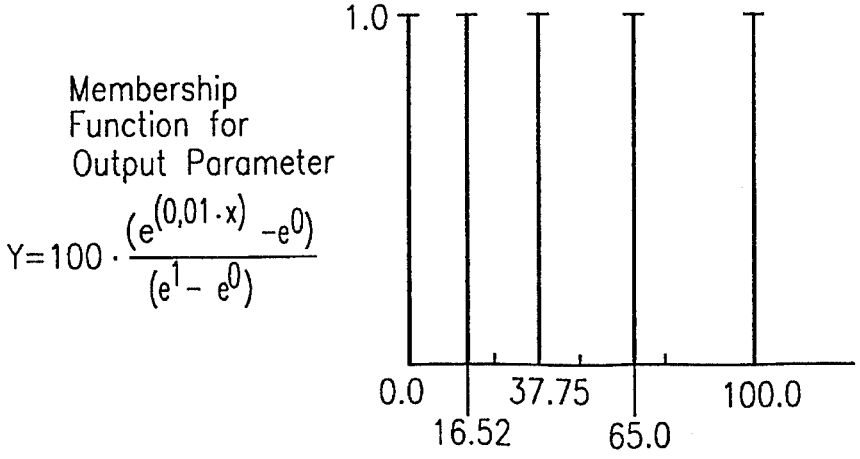

From the journal "Electronik", edition 9/1994, p. 80, it is known to realize such exponential distortions with a fuzzy component. This will be indicated below with reference to FIG. 8*a*, FIG. 8*b* and FIG. 8*c*. With reference to FIG. 8*a* it is assumed that the input parameter X of the fuzzy component has a value range from 0–100 and in correspondence to the membership function shown in FIG. 8*a* is fuzzified with five different value regions. The maximum values of these value regions are at 0, 25, 50, 75 and 100. As shown in FIGS. 8*b* and 8*c*, the value range of the output parameter Y, which represents a function of the input parameter X, is also to be 0–100. However, the output parameter Y is not modeled by means of value regions which cross over one another, but by means of single discrete values, so-called singletons, each having a truth value 1.0. The values of the singletons are yielded by application of the maximum values of the value regions of the input parameter X in the function to be described by the fuzzy component. Thus, FIG. 8*b* shows the realisation of the straight line function Y=X, whereby the values of the singletons of the output parameter Y are obtained by application of the maximum values 0, 25, 50, 75 and 100 in the straight line equation. With the straight line equation there are thus yielded for the singletons the same values as for the maximum values of the value regions of the input parameter X. In contrast thereto, FIG. 8*c* shows the realisation of an exponential function in which likewise the values of the singletons of the output parameter Y are obtained by application of the maximum values 0, 25, 50, 75 and 100 of the value regions of the input parameter X of the corresponding exponential equation shown in FIG. 8*c*. If the fuzzification method shown in FIG. 8*c* is applied to the above-described fuzzy controller 7, it is thus possible in accordance to the invention to provide an exponential dependence between the output parameter of the fuzzy controller, i.e. the setting value for the inverter 3 or the load circuit 4 and the input parameter of the fuzzy controller, for example the control difference of the lamp power or of the lamp current, so that a linear dependence can be realised between the subjective perception of the observer and the brightness power taken up by the lamp.

Figure 9:
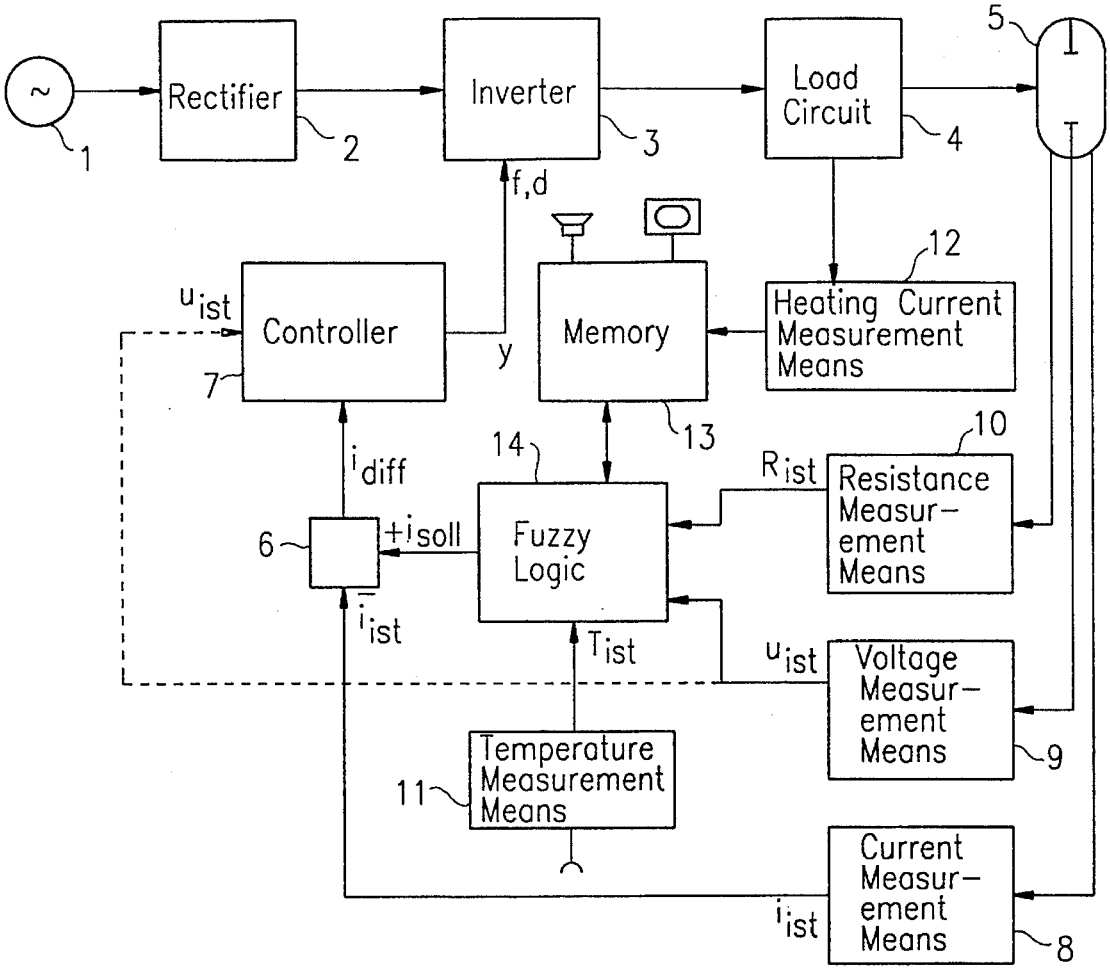
FIG. 9 a schematic block circuit diagram for indication of the lamp recognition in accordance with the invention.

FIG. 9 shows a third exemplary embodiment in accordance with the invention in which in relation to an electronic ballast for a gas discharge lamp use is made of fuzzy logic.

The exemplary embodiment shown in FIG. 9 is based however, independently of the fuzzy logic, on the inventive insight of inferring the lamp type of the gas discharge lamp 5 from different operational parameters of the connected gas discharge lamp after it has been put into operation. It has already been suggested—as mentioned above—to detect the ignition voltage of a connected gas discharge lamp and to infer the lamp type on the basis of the detected ignition voltage. The determination of the ignition voltage depends, however, upon many differing assumptions and parameters, so that the ignition voltage can be detected only inexactly. In contrast, it is proposed in accordance with the invention to detect at least one operational parameter of the lamp after it has been put into operation and to infer the lamp type on the basis of this operational parameter. It is of advantage, however, to monitor a plurality of operational parameters so that the possibility is provided in accordance with the invention to evaluate the operational parameters both individually and also in combination.

The procedure for lamp recognition will be briefly described below in principle. Thereby it will by assumed that the lamp current is the physical quantity which is to be controlled by the control device. After the gas discharge lamp has been put into operation, various lamp current desired values are provided and the lamp current set corresponding to these desired values. For each lamp current desired value the corresponding actual value of the operational parameter of the gas discharge lamp to be monitored is detected. The thus obtained individual actual values of the operational parameters are combined with one another, so that thereupon the lamp type of the connected gas discharge lamp can be inferred on the basis of actual values dependent upon the set lamp current desired values. For this purpose there is conceivable, for example, the evaluation of various predetermined characteristics of individual lamp types. Thus, for example, the current/voltage characteristics of various lamp types may be known. As described above, various current values are set and correspondingly the lamp voltage dependent upon the set current desired values detected. On the basis of the detected current/voltage value pairs and the various available current/voltage characteristics the lamp type of the connected gas discharge lamp can be inferred.

Advantageously, for the evaluation of individual operational parameter values or various operational parameters in combination, fuzzy logic is applied in accordance with the invention. FIG. 9 shows a corresponding exemplary embodiment. For the purpose of the lamp recognition, there are supplied to a fuzzy logic component 14 by means of a resistance measurement means 10 a voltage measurement means 9 and a temperature measurement means 11, the instant actual values of the winding resistance $R_{ist}$, the lamp voltage $u_{ist}$ of the connected gas discharge lamp and the outside temperature $T_{ist}$. The fuzzy logic component 14 provides current desired values to a control device for setting the lamp current and detects in dependence upon the set current desired values the actual values $R_{ist}$, $u_{ist}$ and $T_{ist}$. In this way various actual values $R_{ist}$, $u_{ist}$ and $T_{ist}$ are allocated to several set lamp current values. The controller 7 shown in FIG. 9 may also be realised as a fuzzy controller, whereby a supply of the detected lamp voltage $u_{ist}$ as a further input parameter of the fuzzy controller is of advantage for the purpose of more exact control of the lamp current. On the basis of known dependence between the monitored operational parameters and the individual lamp types, decision rules are set out in advance, on the basis of which the fuzzy logic component 14 associates with actual values of the monitored operational parameters $R_{ist}$, $u_{ist}$ and $T_{ist}$, each available in quantified (fuzzified) form, a corresponding lamp type, in accordance with the procedures of fuzzy logic. The more different current values are employed, the more exactly the determination of the lamp type can be effected. Preferably, the decision rules are set out on the basis of known characteristics of the various lamp types.

Figure 10:
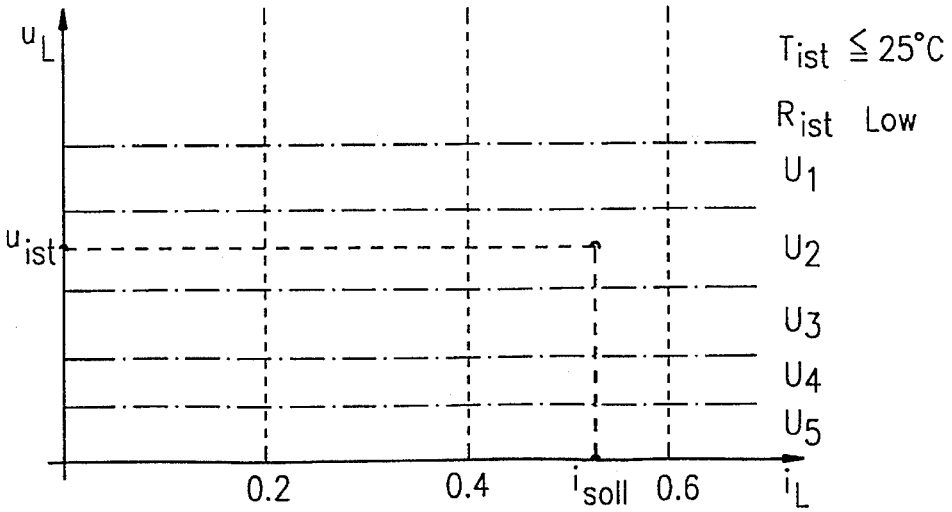
FIG. 10 is a current-voltage diagram of lamp current and lamp voltage for indication of the process in accordance with the invention with which the lamp type of the connected gas discharge lamp can be inferred from the current voltage characteristics.

An example of the allocation of the lamp type to the detected actual values of the outside temperature $T_{ist}$, the winding resistance $R_{ist}$ and the lamp voltage $u_{ist}$ is shown in FIG. 10, where various current-voltage characteristics for various lamp types are represented. The characteristics represented show the current-voltage characteristics of three different lamp types for the temperature region $T_{ist}$ of <=25° C. and for a winding resistance $R_{ist}$ lying below a particular limit value. For other regions of the temperature $T_{ist}$ and of the winding resistance $R_{ist}$ there are determined or are already available further characteristics. The voltage range of the lamp voltage $u_L$ is divided into several regions $u_1$ to $u_5$, i.e. quantified or fuzzified. On the basis of the voltage and current values known to the fuzzy logic component 14, the corresponding lamp characteristic can be inferred from the fuzzified lamp voltage in dependence upon the instant room temperature $T_{ist}$ and the instant winding resistance $R_{ist}$ which are likewise available in quantified form, since the corresponding characteristic must include the set nominal point.

As FIG. 9 shows, it is advantageous to connect a memory 14 with the fuzzy logic 13 so that after the determination of the lamp type this lamp type can be stored in the memory for example in the form of the corresponding lamp characteristic or the form of the various operational parameter values. In this way, a repeated determination of the lamp type and a therewith associated repeated setting of the lamp current of the gas discharge lamp 5 during its operation is not necessary; rather, a single determination of the lamp type is sufficient. Optionally, the lamp type can also be indicated acoustically or optically, so that during the operation of a gas discharge lamp the user is also constantly informed of the connected lamp type. In accordance with the invention, it is further proposed to erase the memory in each case after a change of lamp. Thus, for example by means of detection of an interruption of the heating current circuit of the gas discharge lamp, a change of lamp can be detected with the aid of a heating current measurement means 12 and the memory thereupon erased.

When the lamp type of the connected gas discharge lamp has once been determined, the further control of the lamp brightness is effected in dependence upon the determined lamp type, the fuzzy logic component 14 providing a corresponding current desired value $i_{soll}$, corresponding to the determined lamp type, to the comparator 6.

I claim:

1. Electronic ballast for gas discharge lamps, having a rectifier for rectifying a supply voltage, having an inverter fed from the rectifier, having a load circuit, to which at least one gas discharge lamp can be connected, connected to the inverter, and having a control device with a comparator for controlling the brightness of the at least one gas discharge lamp, characterized in that, the control device includes a fuzzy controller which in dependence upon at least one input signal ($i_{diff}$, $u_{ist}$, $R_{ist}$, $T_{ist}$) determines as output signal a setting value for a physical parameter of the inverter or of the load circuit.

2. Electronic ballast according to claim 1, characterized by a current measurement means for detecting the actual value of the lamp current of the at least one gas discharge lamp.

3. Electronic ballast according to claim 2, characterized in that, the comparator determines a control difference value by means of comparison of the actual value of the lamp current with a settable lamp current desired value, and in that the control difference value is applied to the fuzzy controller as input signal.

4. Electronic ballast according to claim 1, characterized in that, the physical parameter of the inverter, for which the fuzzy controller determines a setting value, is the duty ratio or the frequency of the lamp current or the lamp voltage of the at least one gas discharge lamp.

5. Electronic ballast according to claim 1, characterized by a voltage measurement means for detecting the actual value of the lamp voltage of the at least one gas discharge lamp.

6. Electronic ballast according to claim 5, characterized in that, the actual value of the lamp voltage detected by the voltage measurement means is applied to the fuzzy controller as input signal.

7. Electronic ballast according to claim 6, characterized in that, there is provided a temperature measurement means for detecting the actual value of the environmental temperature, and in that the actual value of the environmental temperature is applied to the fuzzy controller as input signal.

8. Electronic ballast according to claim 6, characterized in that, there is provided a resistance measurement means for detecting the actual value of the winding resistance of the at least one gas discharge lamp, and in that the actual value of the winding resistance is applied to the fuzzy controller as input signal.

9. Electronic ballast according to claim 6, characterized in that, the fuzzy controller generates an output signal dependent upon at least one of the input parameters applied thereto, from which output signal the degree of aging of the connected gas discharge lamp can be derived.

10. Electronic ballast according to claim 3, characterized in that, the desired value of the comparator can be varied.

11. Electronic ballast according to claim 1, characterized in that, the fuzzy controller determines the output signal in accordance with an exponential function dependent upon the input signal.

12. Electronic ballast according to claim 1, characterized in that, when a limit value of one or more of its input signals is present, the fuzzy controller determines the output signal or the output signals independently of the other input signals.

13. Method of recognizing the lamp type of a gas discharge lamp, characterized by the method steps placing the gas discharge lamp in operation, setting various current desired values, setting the lamp current correspondingly to the set lamp current desired values, determining the actual value of at least one operational parameter of the gas discharge lamp in dependence upon the respectively set lamp current desired values, selecting a lamp type from several predetermined lamp types in dependence upon the various lamp current desired values and the respectively thereto determined actual values of the at least one operational parameter and allocation of the selected lamp type to the connected gas discharge lamp.

14. Method according to claim 13, characterized by the further method steps fuzzification of the at least one operational parameter in accordance with fuzzy logic, prescription of at least one decision rule which allocates the at least one fuzzified operational parameter of the gas discharge lamp to one of a plurality of predetermined lamp types, in accordance with fuzzy logic, and selection of one lamp type from the plurality of predetermined lamp types in dependence upon the various lamp current desired values and the respectively detected fuzzified actual values of the at least one operational parameter on the basis of the at least one decision rule.

15. Method according to claim 14, characterized in that, the at least one decision rule is prescribed on the basis of known lamp characteristics for the plurality of predetermined lamp types.

16. Method according to claim 13, characterized in that, the brightness of the connected gas discharge lamp is controlled in dependence upon of the detected lamp type.

17. Method according to claim 15, characterized in that, after detection of the lamp type of the connected gas discharge lamp a lamp current desired value is set at a control device for controlling the lamp current.

18. Method according to claim 16, characterized in that, the brightness or the lamp current of the gas discharge lamp is controlled in accordance with fuzzy logic.

19. Method according to claim 13, characterized in that, the lamp voltage and/or the winding resistance of the gas discharge lamp is or are detected as the at least one operational parameter.

20. Method according to claim 13, characterized in that, as operational parameter for the selection of the lamp type of the gas discharge lamp there is detected the environmental temperature.

21. Method according to claim 13, characterized in that, the detected lamp type is stored in the form of particular operational parameter values and/or of the corresponding lamp characteristic.

22. Method according to claim 21, characterized in that, a change of lamp is recognized, the memory is erased and then lamp type of the new gas discharge lamp is determined.

23. Method according to claim 22, characterized in that, a change of lamp is recognized by means of detection of an interruption of the heating current circuit of the gas discharge lamp.

24. Method according to claim 14, characterized in that, the brightness of the gas discharge lamp is controlled in accordance with an exponential function.

25. Method according to claim 13, characterized in that, the detected lamp type of the gas discharge lamp is indicated optically and/or acoustically.

* * * * *